United States Patent [19]

Rodgers

[11] 4,384,421

[45] May 24, 1983

[54] SHELL CATCHER FOR SHOTGUNS

[76] Inventor: Laverne J. Rodgers, 3012 Thornhill Rd., Winter Haven, Fla. 33880

[21] Appl. No.: 193,376

[22] Filed: Oct. 2, 1980

[51] Int. Cl.[3] ..... F41C 27/00

[52] U.S. Cl. ..... 42/1 T

[58] Field of Search ..... 42/1 T

[56] References Cited

U.S. PATENT DOCUMENTS

| | | | |
|---|---|---|---|
| 3,087,387 | 4/1963 | Browning | 42/1 T |
| 3,603,015 | 9/1971 | Jensen | 42/1 T |
| 3,733,728 | 5/1973 | Kuslich | 42/1 T |
| 3,807,075 | 4/1974 | Mylonas | 42/1 T |
| 3,881,268 | 5/1975 | Petersen | 42/1 T |
| 3,984,932 | 10/1976 | Morton | 42/1 T |

*Primary Examiner*—Charles T. Jordan

*Attorney, Agent, or Firm*—Duckworth, Allen, Dyer & Pettis

[57] ABSTRACT

A shell catcher for semi-automatic auto-loading shotguns which will catch the ejected shell if singly loaded and the last shell from the magazine if multiple loads are used. A mounting plate is attached to the trigger retaining pins on the shotgun receiver. A shell restraint blade is pivotally attached to the mounting plate and is urged to an operative position by a spring in which the blade projects slightly into the ejection port for catching the ferrule of an ejected shell. An inoperative position is defined in which the blade is retracted from the port and shells can be completely ejected. A locking arm senses when a shell is in the magazine causing the blade to be locked in the non-operative position and releases the blade when the magazine is empty. A pawl on the bolt handle is utilized to move the blade from the operative position to the inoperative position.

6 Claims, 6 Drawing Figures

SHELL CATCHER FOR SHOTGUNS

BACKGROUND OF THE INVENTION

1. Field of the Invention

The present invention relates to shell catchers, and more particularly to a shell catcher for semi-automatic, auto-loading shotguns which will catch only the last shell from the magazine.

2. Description of the Prior Art

Many shooters choose to recover empty shells after firing for reloading. When semi-automatic shotguns are fired, the spent casings are ejected through an ejection port and fall to the ground. Thus, the shooter must retrieve the casings from the ground and it is common for such casings to become contaminated or damaged. It is therefore desirable to provide means for retaining an ejected shell in the gun receiver from which it can be removed by hand.

A number of shell catchers for this purpose have been known in the prior art. For example, U.S. Pat. Nos. 3,087,387; 3,609,900; 3,755,946; 3,893,253; and 3,978,602 each teach devices to be attached to the receiver assembly of a gun which will catch each shell as ejected. However, such catchers are not suitable when it is desired to shoot doubles or multiple shots since each caught shell must be removed manually before the next shell can be fired.

A more desirable type of shell catcher is exemplified in U.S. Pat. Nos. 3,733,728; 3,807,075; and 3,984,932 that teach shell catchers adapted to catch the second ejected shell while permitting the first fired shell to be normally ejected. These known devices however have certain disadvantages.

Some of the devices utilize wire loops which are not rugged and are subject to damage and use. Others require modification of the gun to install, and some are bulky which can introduce distraction of the shooter. Therefore, there is a need for a reliable shell catcher that is easily attached to the receiver of the gun without modification, that would affect the resale value of the gun, that does not project outward from the receiver in a manner that would affect the shooter, and which will catch only the last shell from the magazine.

SUMMARY OF THE INVENTION

The improved shell catcher of the invention utilizes an elongate plate attached to the side of the receiver by bolting to the receiver pins. A shell restraint blade is pivoted to the plate and constrained to either an operative position or an inoperative position. In the operative position, the blade projects slightly over the ejection port of the gun sufficiently to catch the brass ferrule of a shell. In the inoperative position, a locking arm holds the blade below the ejection port, permitting a shell to be normally ejected. The locking arm is controlled by a presence of a shell in the magazine to hold the blade inoperative and to thereafter release the blade when the last shell from the magazine is fed into the breech. A pawl on the bolt handle of the gun contacts a cam attached to the blade to retract the blade from the ejection port each time the bolt moves forward. When no shell is in the magazine, the locking arm is released and the blade will be moved to the operative position by a spring as the bolt moves backward responsive to firing and the shell is attempted to be ejected.

Therefore, it is a principal object of the invention to provide an improved shell catcher for semi-automatic shotguns that will catch the shell if singly loaded and only the last shell from the magazine if multiple loads are used.

It is another object of the invention to provide a shell catcher that can be attached to the receiver of a shotgun without objectionable modification of the gun.

It is yet another object of the invention to provide a shell catcher having a minimum bulk and which will not interfere with the normal operation of the gun or distract the shooter.

These and other objects and advantages of the invention will be seen from the detailed description and the drawings.

DETAILED DESCRIPTION OF THE PREFERRED EMBODIMENT

Figure 1:
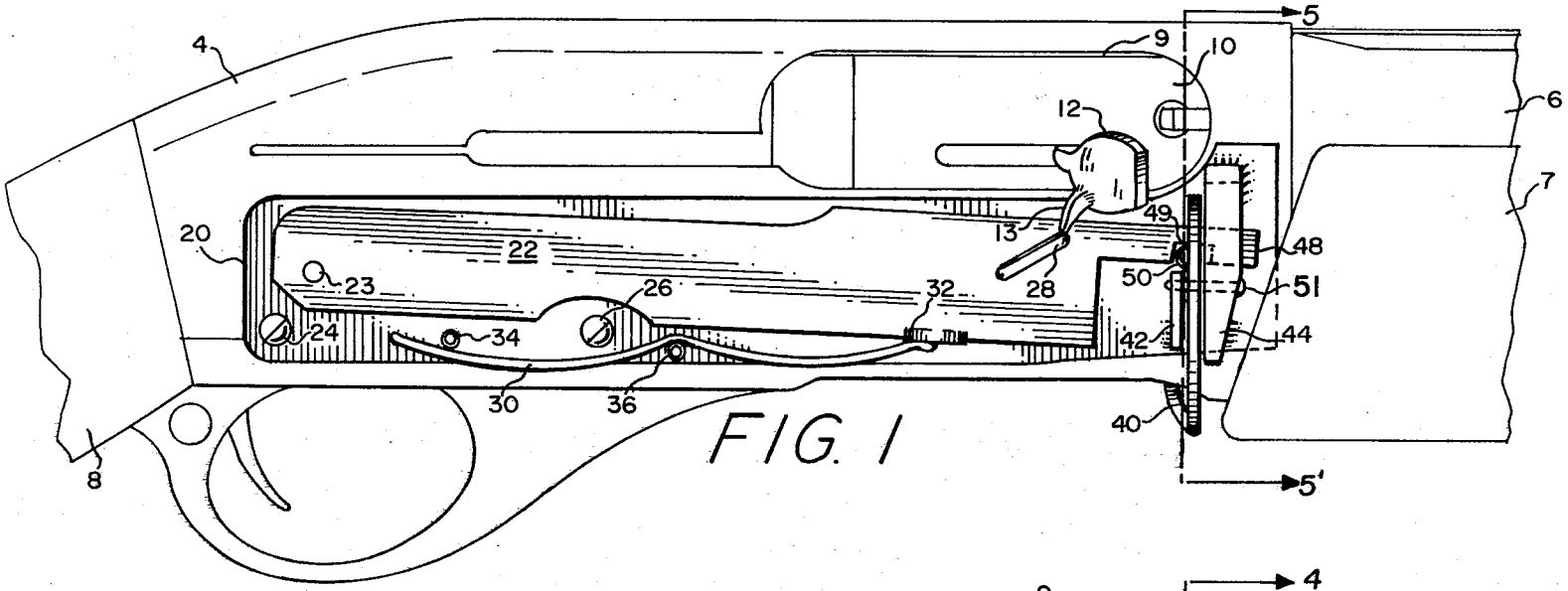
FIG. 1 illustrates the shell catcher of the invention installed on the receiver section of a semi-automatic shotgun with the blade in the non-operative position.
Figure 2:
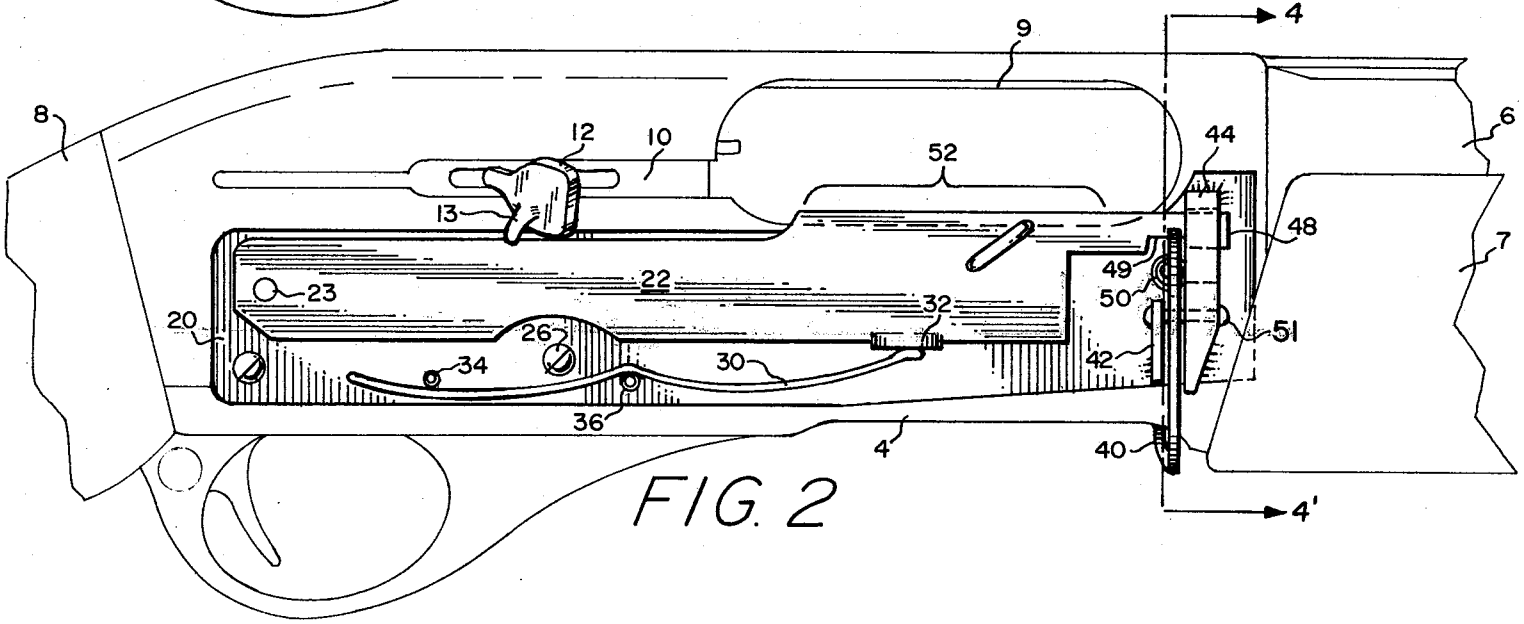
FIG. 2 shows the installation of FIG. 1 in which the bolt is in its rearward position for ejection of a shell and the blade of the invention is in its operative position to catch the shell.
Figure 3:
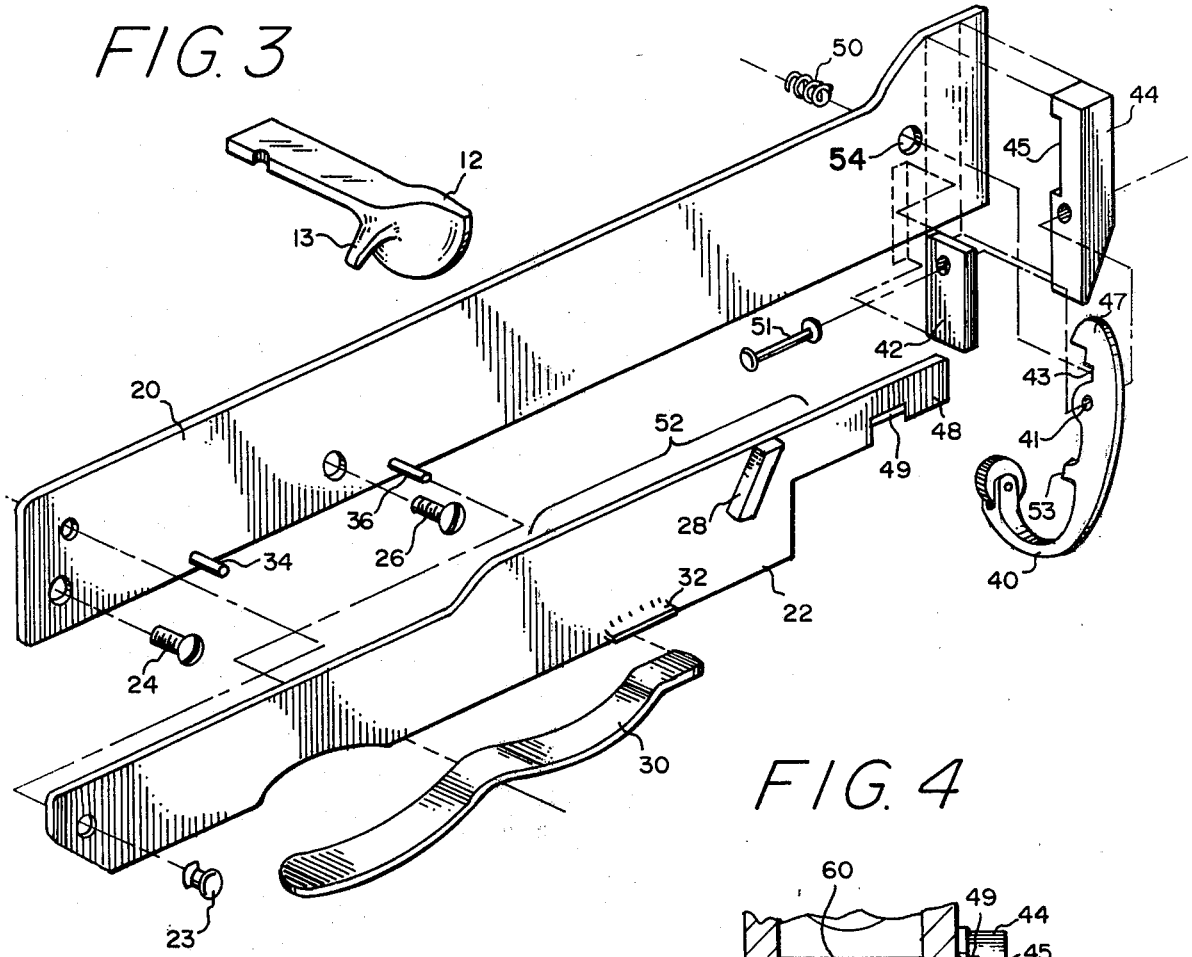
FIG. 3 is an exploded view of the shell catcher showing each of the elements thereof and indicating their arrangement.

The preferred embodiment of the automatic shell catcher of the invention is shown attached to the receiver assembly 4 of a semi-automatic shotgun in FIGS. 1 and 2, and in an exploded view in FIG. 3. The basic elements of the device are best seen in FIG. 3. Receiver plate 20 is to be attached to receiver 4 and supports shell restraint blade 22 pivotally attached to plate 20 by rivet 23. Restraint blade 22 includes an arm portion 48 which projects into a slot 45 in stop bar 44. The ends of slot 45 define two positions for blade 22: an operative position shown in FIG. 2 in which restraint edge 52 of blade 22 projects slightly into ejection port 9; and an inoperative position shown in FIG. 1 in which blade 22 is lowered, leaving port 9 open to permit a fired shell to be ejected.

Figure 4:
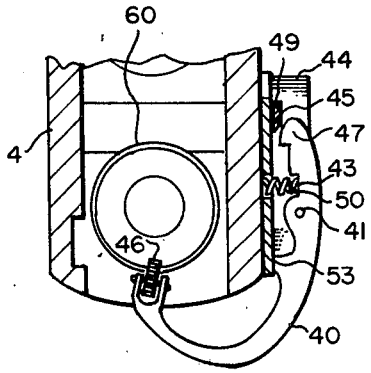
FIG. 4 is a cross-section through the receiver of FIG. 2 showing an empty magazine and the position of the locking arm in such instance.

Blade 22 is biased upward by leaf spring 30 mounted on spring pins 34 and 36. A small tab 32 is formed along the lower edge of blade 22 for contacting spring 30. When blade 22 is in its operative position, arm 48 is stopped by the upper portion of stop bar 44. Locking arm 40 is pivoted through pivot hole 41 by pin 51 which is inserted through bar 44 and bracket 42. A small compression spring 50 disposed in hole 54 in plate 20 bears against gun receiver 4 and spring notch 43 in locking arm 40. Spring 50 tends to force locking arm catch 47 open permitting spring 30 to force blade 22 to its upward operative position. However, when a shell is in the magazine of the gun, roller 46 on the lower end of locking arm 40 moves arm 40 and therefore locking arm catch 47 to a closed position. In this position, catch 47 can hold catch arm blade portion 49 of blade 22 in the non-operative position, compressing spring 50. The non-operative position is shown in the cross sectional view through receiver 4 in FIG. 5 in which it may be noted that the flange of shell 62 forces roller 46 down, closing catch 47 against plate 20 thus holding arm blade portion 49. FIG. 4 illustrates the condition when no shell is in magazine 60 which permits roller 46 to move upward until stop 53 of locking arm 40 contacts plate 20. This movement is sufficient to open catch 47 as shown permitting spring 30 (shown in FIG. 2) to move blade 22 upward in stop bar slot 45 until arm 48 contacts the upper portion of bar 44.

Also shown in FIG. 3 is bolt handle 12 which has a pawl 13 added thereto. Pawl 13, as will be described below, contacts retraction cam 28 on blade 22 causing blade 22 to move from its operative position to its inoperative position.

Turning now to FIGS. 1 and 2, receiver plate 20 may be seen to be attached to the right side of receiver 4 below ejection port 9. Although various means may be used to make the attachment, a simple method is to drill and tap the right ends of two trigger assembly retaining pins (not shown) to accept screws 24 and 26. Additionally, the lower corner of the forward end of plate 20 may be forced between forearm 7 and receiver 4 to additionally secure plate 20. Locking arm 40 extends downward and into the magazine portion of receiver 4 as best seen in the cross sectional views of FIG. 4 and 5 previously discussed. As may now be noted, the only changes necessary in the gun to use the shell catcher of the invention is the tapping of the receiver pins and the addition of pawl 12 to bolt handle 12. Thus, if a gun on which the invention has been mounted is to be sold, simply replacing the drilled and tapped pins with new pins and substituting the bolt handle with a new bolt handle, the gun will be returned to its original condition. Advantageously, the installation of the shell catcher does not require drilling of holes in the receiver or otherwise permanently modifying the gun.

Figure 5:
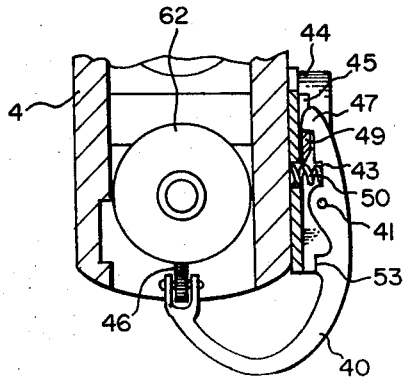
FIG. 5 is a cross section of the receiver of FIG. 1 illustrating a shell in the magazine and the position of the locking arm and the blade in the inoperative position.

Having now described the structure of the preferred embodiment of the invention, its operation will be described. Assume first that there is a shell in the magazine as illustrated in FIG. 5 and that, referring to FIG. 1, bolt 10 is in its forward position and ready for firing with a shell in the breech. Since bolt handle 12 is in its forward position, pawl 13 contacts cam 28 on blade 22, forcing catch arm 49 downward. Advantageously, catch arm blade 49 has a sharpened edge along the lower portion which permits it to be forced between catch 47 and plate 20 and to thereby be caught such that blade 22 is held in its non-operative position. When the gun is fired, bolt 10 moves back and the shell from the breech is ejected through ejection port 9 since blade 22 remains locked in its non-operative position.

Figure 6:
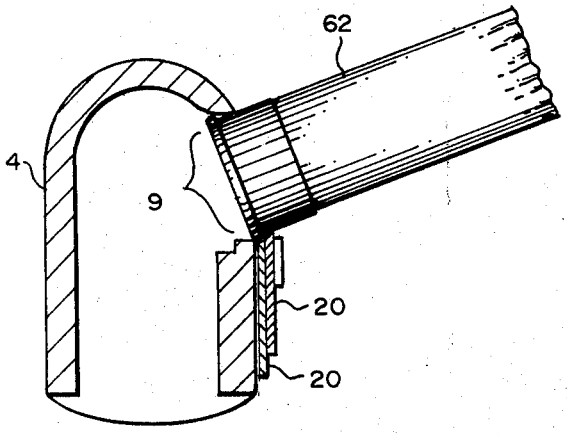
FIG. 6 is a cross sectional view of the gun receiver with the blade in the operated position and showing a shell caught by the invention.

Next, assume a single shell in the magazine is moved into the barrel breech and bolt 10 moves to its closed position. Assuming that the magazine is now empty as illustrated in FIG. 4, spring 50 moves locking arm 40 outward opening catch 47. As bolt 10 moves to its closed position, pawl 13 again forces blade 22 downward but, since catch 47 is open, it will not lock. Therefore when the shell in the chamber is fired and bolt 10 moves to the rear, spring 30 forces blade 22 into its operative position as in FIG. 2. Then when shell 62 is ejected through port 9, the rim catches on restraint edge 52 as shown in FIG. 6 permitting manual removal by the shooter.

It is to be noted from FIG. 4 and FIG. 5 that locking arm 40 does not interfere with loading of magazine 60 or in the movement of shells from the magazine to the chamber by virtue of roller 46 which permits the shell to move over the roller with little friction. From the various figures, it may also be noted that the shell catcher of the invention has a very shallow profile and therefore will not interfere with the normal gun operation and will not distract the shooter. Although not shown, it is obvious that a shallow metal or plastic cover can be mounted over the apparatus, leaving clearance for pawl 13 and for locking arm 40, which will give a finished appearance to the device.

It is to be further understood that the preferred embodiment of the invention herein described is for exemplary purposes only and it is anticipated that many obvious changes can be made without departing from the spirit and scope of the invention. For example, due to the inherent simplicity of the use of a receiver plate having a flat ejection restraint blade pivoted thereto those of skill in the art may modify the disclosed design to an even shallower design and therefore I am not to be limited to the disclosed implementation.

I claim:

1. A shell catcher for a semi-automatic shotgun, said shotgun having a receiver assembly and a receiver, a magazine, a bolt and bolt handle, and an ejection port for firing shotgun shells having a rim, comprising:

mounting plate means for attachment to the receiver assembly of the shotgun;

shell restraint blade means pivotally attached to said mounting plate means, said shell restraint blade means having a blade adapted to pivot to an operative position in which a portion of said blade projects into the ejection port of the shotgun for catching an ejected shell, and to a non-operative position in which said blade is clear of the ejection port, said shell restraint blade means including biasing means for urging said blade to said operative position;

blade locking means having sensing means for sensing the presence of a shell in the magazine of a shotgun, said blade locking means adapted to hold said blade in said non-operative position when a shell is in the magazine and to permit said blade to move to said operative position when the magazine is empty; and pawl means associated with the bolt handle of the shotgun for moving said blade to the non-operative position when the bolt is in a forward position for firing.

2. The device as defined in claim 1 in which said shell restraint blade means comprises:

an elongate metal strip forming said blade and having a pivot at its rearward end and a narrow forward-extending stop arm positioned at its forward end;

a restraint edge formed by the forward top edge of said strip for projecting into the ejection port of the shotgun;

a cam disposed adjacent said restraint edge for contact by said pawl means;

a stop bar defining two stop positions, said bar attached to the forward end of said mounting plate means for receiving said stop arm, one of said stop positions corresponding to an operative position and the other of said stop positions corresponding to a non-operative position; and said biasing means including spring means attached to said mounting plate means, said spring means bearing on said metal strip tending to urge said metal strip in an upward direction.

3. The device as defined in claim 2 in which said blade locking means comprises:

an arcuate locking arm pivoted from said mounting plate means at the forward end thereof, said locking arm having an upper catch portion for capturing said stop arm when said restraint blade is in its non-operative position, and a compression spring for biasing said upper catch portion to an open position; and said sensing means comprises a lower portion of said locking arm extending into the receiver of the shotgun adjacent the magazine, said lower portion for contacting the rim of a shell in the magazine thereby moving said locking arm and upper catch portion into its closed position against said compression spring.

4. The device as defined in claim 3 in which said lower portion of said locking arm includes a roller for contacting the rim of a shell in the magazine and to facilitate movement of a shell into and out of the magazine.

5. The device as defined in claim 3 in which said pawl means comprises a projection on said bolt handle projecting downward for contacting said cam when the bolt of the shotgun moves to its forward position.

6. A semi-automatic shotgun of the type having a shell holding magazine, a bolt and bolt handle, a receiver assembly and receiver, and an ejection port, said shotgun adapted to catch an ejected shell when the magazine is empty, comprising:

an elongate metal mounting plate attached to the receiver assembly of the shotgun below the ejection port;

an elongate blade pivotally attached to the rear end of said mounting plate and projecting forward, said blade having a shell restraint edge along the top forward edge of said blade and a narrow stop arm projecting forward at the forward end of said blade;

a stop bar attached to the forward end of said mounting plate for receiving said stop arm and defining an upper stop position in which said restraint edge projects into said ejection port, and a lower stop position defining a position of said restraint edge below the ejection port;

a spring attached to said mounting plate and bearing on a lower edge of said blade for urging said blade into the first position;

a locking arm pivotally attached to the forward end of said mounting plate and adapted to have a lower sensing portion thereof projecting under and into the magazine section of the shotgun, said lower section including a roller for contacting a shell when in the magazine;

a compression spring disposed between said receiver and said locking arm for urging the upper portion of said locking arm outward; and a blade arm catch disposed at the upper end of said locking arm, said catch adapted to capture said forward projecting arm of said blade when said blade is in the second position and said roller is contacting a shell, said catch releasing said arm responsive to the action of said compression spring when no shell is in the magazine.

* * * * *